United States Patent [19]

Caron

[11] Patent Number: 5,029,339

[45] Date of Patent: Jul. 2, 1991

[54] TELEPHONE ENCLOSURE WITH ILLUMINATED DISPLAY

[75] Inventor: Michael P. Caron, Pickering, Canada

[73] Assignee: CDA Industries Inc., Scarborough, Canada

[21] Appl. No.: 343,415

[22] Filed: Apr. 26, 1989

[51] Int. Cl.[5] ..... H04M 1/00; G09F 3/00; G09F 7/18

[52] U.S. Cl. ..... 379/453; 52/32; 52/38; 52/36; 40/336; 40/339

[58] Field of Search ..... 379/453, 155, 143; 52/27, 28, 32, 38, 36; 40/339, 336, 371; 362/88, 24

[56] References Cited

U.S. PATENT DOCUMENTS

| | | | |
|---|---|---|---|
| 2,821,033 | 1/1958 | Gee | 52/28 |
| 3,300,917 | 1/1967 | Bartley et al. | 379/453 |
| 3,845,590 | 11/1974 | Ertl | 379/453 |
| 4,638,605 | 1/1987 | Rosa | 52/28 |
| 4,754,582 | 7/1988 | Cameron | 52/28 |
| 4,845,864 | 7/1989 | Martin | 379/453 |

*Primary Examiner*—Jin F. Ng
*Assistant Examiner*—Jason Chan

[57] ABSTRACT

A telephone enclosure having an upper housing and two spaced apart side housings, defining a telephone recess, illumination tubes in the upper and side housings, displays attached to the upper and side housings, each display having a transparent front panel, a rear diffuser panel, and a frame to enclose the front and rear panels.

7 Claims, 2 Drawing Sheets

TELEPHONE ENCLOSURE WITH ILLUMINATED DISPLAY

FIELD OF THE INVENTION

The invention relates to an illuminated telephone enclosure and, in particular, to such an enclosure which combines the functions of providing both illumination, and information, to the user of the telephone.

BACKGROUND OF THE INVENTION

Pay telephones, hotel house telephones, and the like are usually installed in some form of enclosure. Sometimes the enclosure is a four-sided booth. In other cases, it is simply a partial shelter under which a person can stand while using the telephone. It is desirable that the enclosure of whatever kind shall provide some kind of illumination to assist the user in locating and dialling telephone numbers, inserting coins, writing notes, and the like. In the past, the illumination has usually been provided in an essentially utilitarian manner at minimal cost. The enclosure, and its illumination, however simple it might be, represented an installation expense, which was paid for only out of the user fees paid for the use of the telephone.

It is however a fact that the person using the telephone is a captive audience, for any information which it may be possible to display around the telephone. This makes it a particularly suitable location for erecting advertising, which can earn revenue in addition to the user fees.

SUMMARY OF THE INVENTION

With a view to combine these two functions, the invention comprises a telephone enclosure with an illuminated display and comprising a housing means having an upper portion, and two spaced apart side portions defining a telephone recess within said housing means, opening means in said upper portion and said side portions of said housing means, illumination means in said upper portion and said side portions of said housing means, upper display means adapted to be attached to said upper portion of said housing means, side display means adapted to be attached to respective side portions of said housing means, each of said display means, in turn, comprising a transparent front panel, a rear diffuser panel, frame means adapted to enclose said front and rear panels, and engagement means adapted to engage at least said rear panel, and hold the same against said front panel whereby a display sheet may be placed between said front and rear panels, and held therebetween; and illuminated from the rear.

More particularly, it is an objective of the invention to provide a telephone enclosure having the foregoing advantages and further including a roof portion, comprising upper and lower walls and side walls, and front and rear panels, and illumination means mounted in said roof portion, and at least one of said front and side panels being formed of transluscent material, adapted to display a message, said roof portion being mounted along an upper portion of said housing means.

More particularly, it is an objective of the invention to provide a telephone enclosure having the foregoing advantages wherein said frame means of each said display means are hingedly mounted along their respective lower edges, whereby the same may be swung to change said display sheets.

More particularly, it is an objective of the invention to provide a telephone enclosure having the foregoing advantages and wherein said engagement means comprises, for each said display means, a strip of resilient material formed into a rectangular shape, and wherein said frame comprises a generally L-shaped structure in section, having a front wall and a side wall, and wherein said resilient means is adapted to fit within said frame side wall, and engage said rear panel.

More particularly, it is an objective of the invention to provide a telephone enclosure having the foregoing advantages and including privacy panels mounted on opposite sides of said housing means, and extending substantially normal thereto in spaced apart parallel planes.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF A SPECIFIC EMBODIMENT

Figure 1:
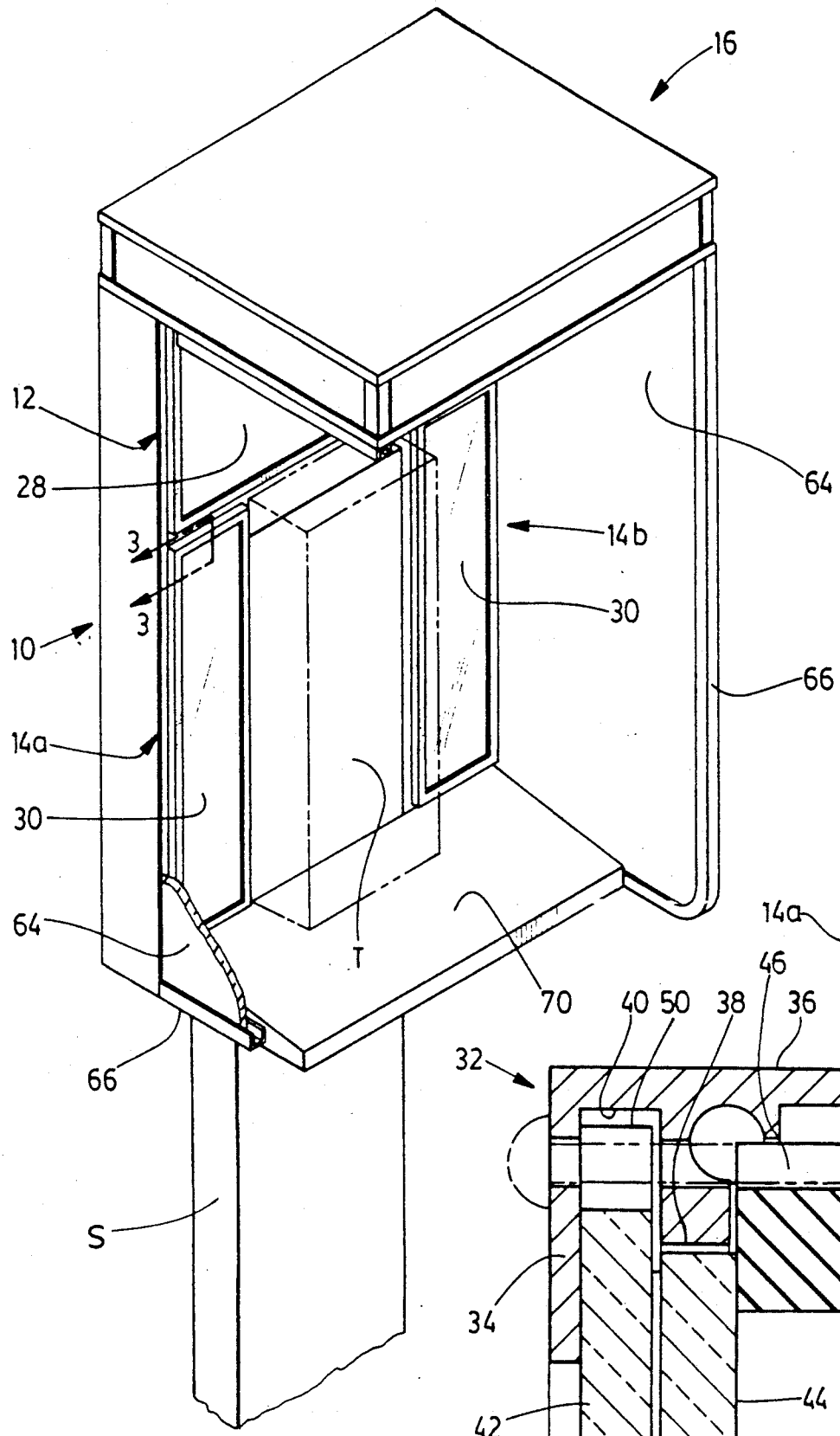
FIG. 1 is a perspective illustration of a telephone enclosure in accordance with the invention, shown partially cut away.

Referring first of all to FIG. 1, it will be seen that the invention is illustrated in the form of a telephone enclosure indicated generally as 10 having an upper housing portion 12, and two side housing portions 14A and 14B, collectively forming generally rectangular housing means.

A roof portion 16 is provided, and optionally, some form of stand or support S may also support the enclosure at a suitable elevation for use by a person standing up. A telephone is illustrated schematically in phantom as T.

Figure 2:
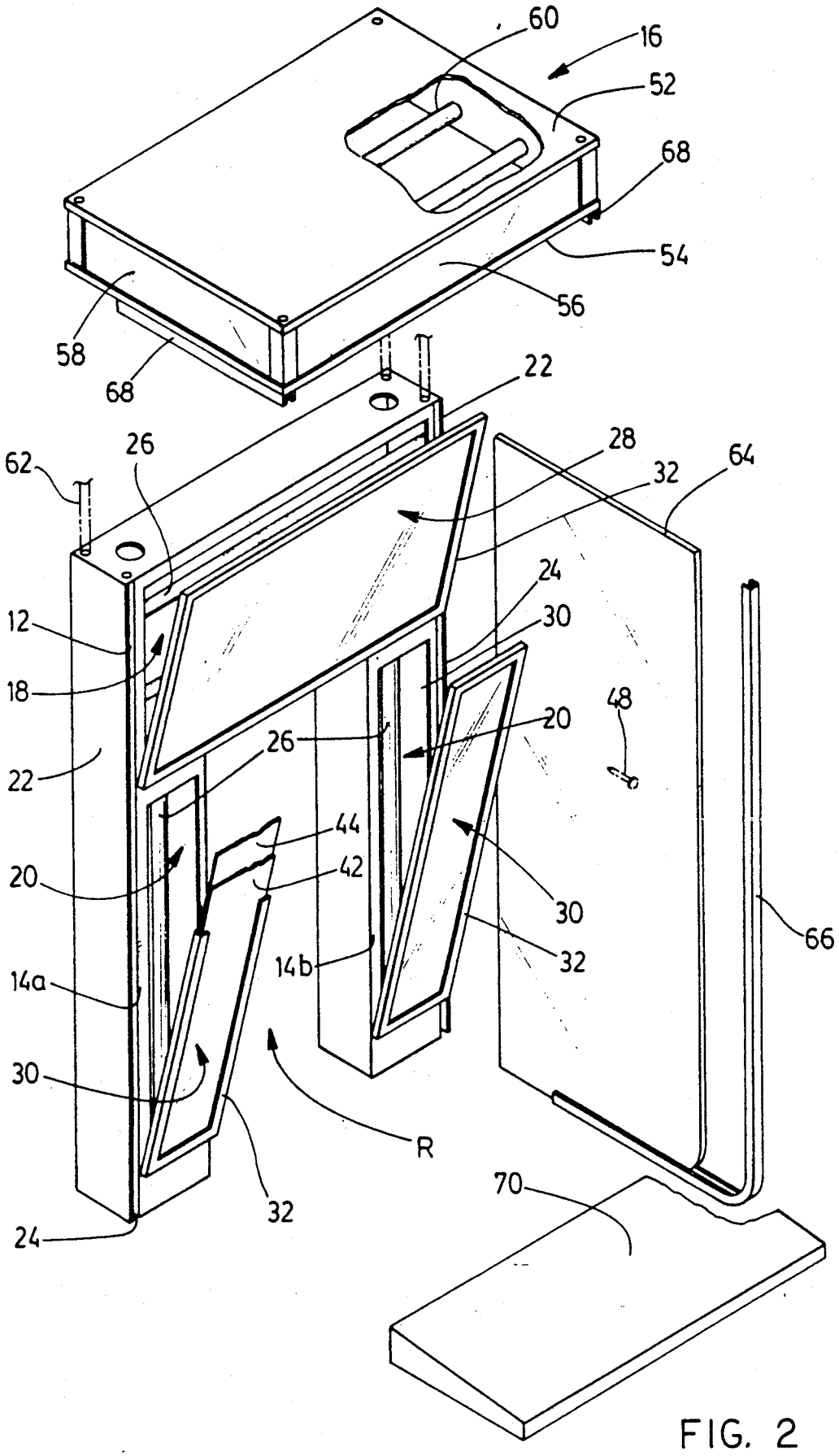
FIG. 2 is an exploded perspective illustration of a telephone enclosure, and, FIG. 3 is a section along the line 3—3 of FIG. 1.

Referring now to FIG. 2, the upper housing portion 12 will be seen to comprise a generally four-sided rectangular box-like structure, having an opening at its front indicated as 18. The side housings 14A and 14B are elongated rectangular box-like structures defining front openings 20—20. Between side housings 14A and 14B a generally rectangular recess R is defined for reception of the telephone T.

It will be appreciated that the housings 12 and 14A–14B can be made in a variety of forms of construction, and will typically be made as three separate components and fastened together by any suitable means (not shown). Exterior finish strips 22—22 extend up either side of the outwardly directed sides of the housings 14A–14B and 12. Elongated channels or grooves 24—24 are formed between finish strips 22 and their respective housings for purposes to be described below.

Illumination is provided in the form of lighting tubes 26 located in the housings 12, 14A–14B.

In order to hold a display sheet (not shown), upper and side display panel means indicated as 28 and 30—30 are provided, being hingedly mounted along their lower edges to respective upper and side housings.

Figure 3:
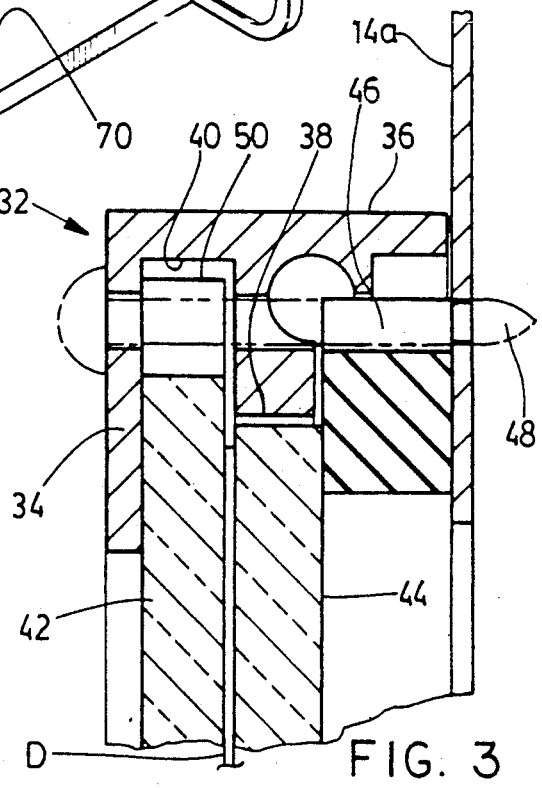

As shown in FIG. 2 and in more detail in FIG. 3, each of the display panel means comprises a generally rectangular frame 32, all four sides of which comprise an identical extrusion (FIG. 3). The frame 32 defines a facing flange 34, and an edge wall 36, and an interior shoulder 38. Shoulder 38 and facing flange 34 are spaced apart from one another and define a channel 40. Channel 40 is adapted to receive the edges of a transparent front display panel 42 having a predetermined height and width. A rear diffuser panel 44 is provided having a predetermined height and width less than that of said front display panel 42. Rear panel 44 is sized so as to make a snug fit within shoulder 38 and has a finger-notch (not shown).

In this way, the front panel 42 is retained by the frame, whereas the rear panel 44 can be moved manually.

Panels 42 and 44 are adapted to retain and sandwich a display sheet indicated generally as D. Display sheet D will be of transluscent material suitable for back lighting in a manner well known in the art and will carry any information or advertising or both which it is desired to display.

Retaining means for the rear panel are provided which, in this embodiment, comprise generally rectangular strips of resilient material 46 adhesively bonded to housings 12 and 14*a*–14*b*. They are dimensioned to fit within frames 32, and to overlap and abut against rear diffuser panels 44. Other retaining means would also serve this purpose.

As shown in FIG. 2, the display panel means 28 and 30—30 are shown swung partially open. It will be appreciated that they can be swung downwardly to a greater angle. When swung downwardly, the rear diffuser panel 44, can be swung away from the front panel 42. A display sheet D can then be inserted or changed, after which the diffuser panels 44 can be returned to their position as shown in FIG. 3. The panel means 28 and 30 are then swung upwardly against their respective housings squeezing strips 46 and are then fastened in position by means such as screws 48.

Front panels 42 are provided with suitable notches 50 at spaced intervals to receive screws 48, registering with suitable holes (not shown) in frames 32 (not shown).

Roof portion 16 will be seen to comprise upper and lower panels 52 and 54, and generally rectangular transluscent or transparent front and side panels 56 and 58. Lighting tubes 60 are located within roof portion 16. The front and side panels 56 and 58—58 may carry any suitable graphic message, or advertising, or both, suitable for backlighting in a manner known in the art. Roof portion 16 is secured to the top of upper housing portion 22, by any suitable means such as for example bolts 62 shown in phantom.

In order to provide some degree of privacy to users of the telephone, privacy panels 64—64 are provided, typically being formed of tempered glass or the like. Panels 64 are received in channels 24, and are retained in position by means of a generally L-shaped partial frame 66—66.

Upper channels 68—68 are fastened to the underside 54 of roof portion 16 to receive the upper edges of privacy panels 64.

A sloping shelf 70 is secured to the fronts of the two housings 14A and 14B. Frames 66—66 are secured to housings 14A and 14B, and to proof portion 16, and are also secured to the ends of shelf 70.

The operation of the invention is self-evident from the description. Information, or advertising, or both, to be displayed around the telephone itself on suitable display sheets D is installed between the front panel 42 and the rear panel 44 of each of the display panel means 28 and 30—30. Preferably this will be advertising material and will thus earn revenue. The display sheets D are readily interchangeable. Thus the invention provides an effective means of displaying information and advertising which can be readily updated and/or changed to suit the needs of customers and, at the same time, provides illumination around the telephone for the assistance of the user of the telephone.

The foregoing is a description of a preferred embodiment of the invention which is given here by way of example only. The invention is not to be taken as limited to any of the specific features as described, but comprehends all such variations as come within the scope of the appended claims.

What is claimed is:

1. A telephone enclosure with an illuminated display and comprising:

housing means having an upper portion, and two spaced apart side portions, defining a telephone recess, within said housing means;

opening means in said upper portion and said side portions of said housing means;

illumination means in said upper portion and said side portions of said housing means;

upper display means adapted to be attached to said upper portion of said housing means;

side display means adapted to be attached to respective side portions of said housing means, each of said display means, in turn, comprising:

a transparent front panel of predetermined height and width;

a rear diffuser panel of a predetermined height and width less than said front panel;

frame means adapted to enclose said front and rear panels and defining a retaining channel for retaining said front panel in position, said rear panel being moveable relative to said frame means and said front panel, and, an engagement strip of resilient material adapted to fit within said frame means and to engage at least said rear panel, and hold the same against said front panel whereby a display sheet may be placed between said front and rear panels, and held therebetween, and illuminated from the rear.

2. A telephone enclosure as claimed in claim 1 and further including a roof portion, comprising upper and lower walls and side walls, and front and side panels, and illumination means mounted in said roof portion, and at least one of said front and side panels being formed of transluscent material, adapted to display a message, said roof portion being mounted along said upper portion of said housing means.

3. A telephone enclosure as claimed in claim 2 wherein said frame means of each said display means is hingedly mounted along their respective lower edges, whereby the same may be swung to change said display sheets.

4. A telephone enclosure as claimed in claim 3 and wherein said engagement strip comprises, for each said display means, a strip of resilient material formed into a rectangular shape, and wherein said frame means comprises a generally L-shaped structure in section, having a front wall and a side wall, and wherein said rectangular strip of resilient material is adapted to fit within said frame side wall, and engage said rear panel.

5. A telephone enclosure as claimed in claim 4 and including vertical spaced-apart channels formed along sides of said housing means, and privacy panels mounted on opposite sides of said housing means received in said vertical channels, and extending substantially normal to said housing means in spaced apart parallel planes.

6. A telephone enclosure as claimed in claim 5 and including finish strips secured to said housing means along either side thereof, edge portions of said finish strips, and said housing means, together defining said vertical channels.

7. A telephone enclosure as claimed in claim 3 wherein said frame means further defines interior shoulder means for locating said rear panel, and including notch means formed in said front panel, and fastening means extending through said notch means, for securing said display means in position on respective said housing portions.

* * * * *